US006206253B1

(12) United States Patent
Kolton et al.

(10) Patent No.: US 6,206,253 B1
(45) **Date of Patent: *Mar. 27, 2001**

(54) HANGER FOR SUSPENDERS

(75) Inventors: Chester Kolton, Westfield; Michael Norman, East Brunswick, both of NJ (US)

(73) Assignee: B&G Plastics, Inc., Newark, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/252,450

(22) Filed: Feb. 18, 1999

(51) Int. Cl.[7] ..... A47Q 25/14
(52) U.S. Cl. ..... 223/85; 223/87
(58) Field of Search ..... 223/85, 87, DIG. 1, 223/88, 94, 89; D6/315

(56) References Cited

U.S. PATENT DOCUMENTS 4,714,156 * 12/1987 Kolton et al. ..... 206/296
4,718,546 * 1/1988 Kolton et al. ..... 206/296
4,759,440 * 7/1988 Kolton et al. ..... 206/296
4,940,146 * 7/1990 Kolton et al. ..... 211/113
5,615,810 * 4/1997 Kolton et al. ..... 223/85
5,772,087 * 6/1998 Kolton ..... 223/1
5,826,760 * 10/1998 Kolton et al. ..... 223/85
5,857,597 * 1/1999 Kolton ..... 223/85

* cited by examiner

*Primary Examiner*—Bibhu Mohanty
(74) *Attorney, Agent, or Firm*—Robin, Blecker & Daley

(57) ABSTRACT

A hanger and suspenders arrangement includes a hanger comprised of a main body portion defining a plurality of retention members, and a flap member, the flap member defining a plurality of securement parts corresponding to the retention member plurality, the flap member being applied to the main body portion and the securement parts being interfitted with the retention members and defining first and second channels between the main body portion and the flap member and suspenders including first and second straps, portions of the first and second straps being disposed between the main body portion and the flap member respectively in the first and second channels, other portions of the first and second straps being disposed respectively downwardly and frontally of the flap segment.

20 Claims, 3 Drawing Sheets

HANGER FOR SUSPENDERS

FIELD OF THE INVENTION

This invention relates generally to hangers for the hanging of wearing apparel and pertains more particularly to hangers for the hanging of suspenders.

BACKGROUND OF THE INVENTION

Commonly-assigned U.S. Pat. Nos. 4,714,156 and 4,718,546 address the hanging of suspenders of the type having stems with slots therein for receiving buttons disposed interiorly on a trouser waistband. Another type of suspenders is in quite widespread use and useful with trousers not having suspender-receiving buttons on its waistband. That suspenders type has stems equipped with snaps adapted to receive and retentively close upon the waistband of trousers.

A hanger for the hanging of suspenders of the snap variety is shown in commonly-assigned U.S. Pat. No. 4,759,440, which notes a problem attending such suspenders, namely, that the snaps need be closed at the point of manufacture, to avoid entanglement of the snaps with one another during shipment. The '440 patent provides a hanger adapted to receive suspenders with the snaps thereof in closed state and the hanger may be applied to the suspenders either at the point of manufacture and shipment or at a retail facility. Another hanger for the hanging of suspenders of the snap variety is shown in commonly-assigned U.S. Pat. No. 5,615,810. The '810 patent provides a hanger comprised of an elongate, one-piece body of plastic material, the hanger having a hook portion, a logo display portion, a main body portion having arms extending oppositely, horizontally therefrom to respective free ends for receipt of closed suspender snaps, and a retention member. A fold line segment is defined in the body below the main body portion and a flap member is defined in the body below the fold line segment. The retention member and the flap member have interfitting securement parts and define a sidewardly open, horizontal slot therebetween.

In use of the hanger of the '810 patent, a suspenders is applied to the hanger by inserting the main body portion arms through the closed snaps of the suspenders. The suspender straps are then inserted into the horizontal slot and the flap member is then folded about the fold line segment into registry with the retention member and the securement parts thereof are interfit. The securement parts are of a type which, once interfit, cannot be opened without cutting and disfiguring the hanger.

A disadvantage of the foregoing hangers is their requirement for vertical display space which is at least the full length of the suspenders. While a further, commonly-assigned patent, i.e. U.S. Pat. No. 4,940,146 provides for hanging suspenders in limited vertical display space by providing for half lengths of the suspenders to hang forwardly and rearwardly of the hanger, a disadvantage of the '146 patent hanger is that a suspenders is readily removed from the hanger, giving rise to possible fraud by purchasers in shifting more expensive suspenders to hangers bearing less expensive price indication.

SUMMARY OF THE INVENTION

The present invention has as its primary object the provision of hangers for the hanging of suspenders in limited vertical display space but nonetheless providing anti-fraud facility.

In attaining the foregoing and other objects, the invention provides, in one combination, a hanger comprised of a main body portion defining a plurality of retention members, and a flap member, the flap member defining a plurality of securement parts corresponding to the retention member plurality, the flap member being applied to the main body portion and the securement parts being interfitted with the retention members and defining first and second channels between the main body portion and the flap member and suspenders including first and second straps, portions of the first and second straps being disposed between the main body portion and the flap member respectively in the first and second channels, other portions of the first and second straps being disposed respectively downwardly and frontally of the flap segment.

The foregoing and other objects and features of the invention will be further understood from the following detailed description of preferred embodiments thereof and from the drawings wherein like reference numerals identify like parts throughout.

DETAILED DESCRIPTION OF PREFERRED EMBODIMENTS AND PRACTICES

Figure 2:
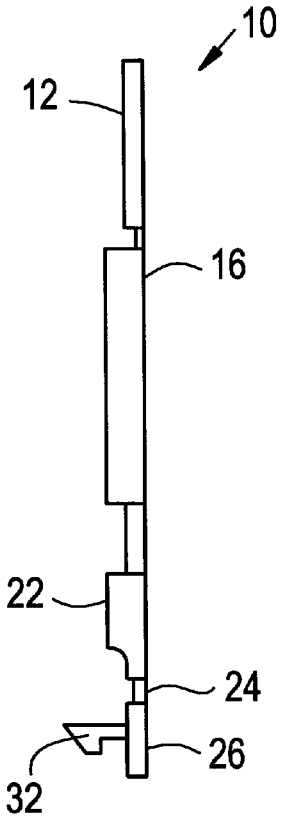
FIG. 2 is a right side elevation of the FIG. 1 hanger.
Figure 1:
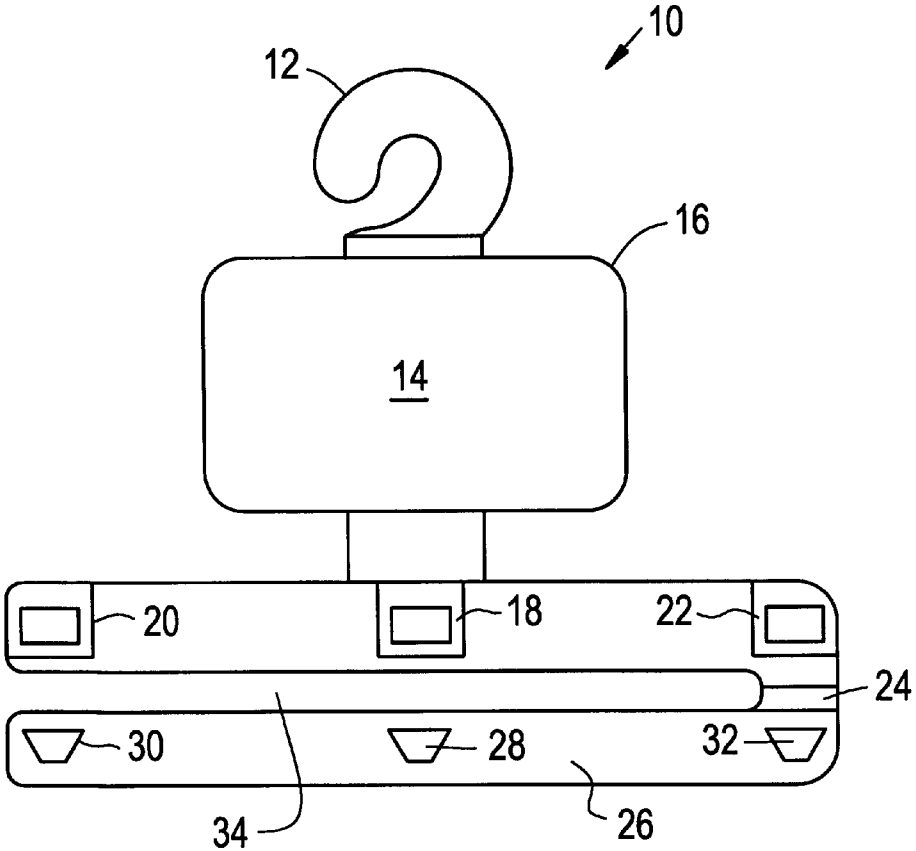
FIG. 1 is a front elevation of a hanger in accordance with the invention.

Referring to FIGS. 1 and 2, hanger 10 of the first embodiment of the present invention is comprised of an elongate, one-piece body of plastic material, the hanger having a hook portion 12, a logo display portion 14 and a main body portion 16.

Main body portion 16 defines a plurality of retention members including central retention member 18 and sideward retention members 20 and 22, situated substantially marginally of main body portion 16.

Fold line segment 24 depends from the main body portion and a flap member 26 depends from the fold line segment. Flap member 26 defines a plurality of securement parts corresponding to the retention member plurality, inclusive of a central securement part 28 and sideward securement parts 30 and 32. Slot 34 opens into the leftward margin of hanger 10 and is bounded by main body 16, fold line segment 24 and flap member 26.

Figure 3:
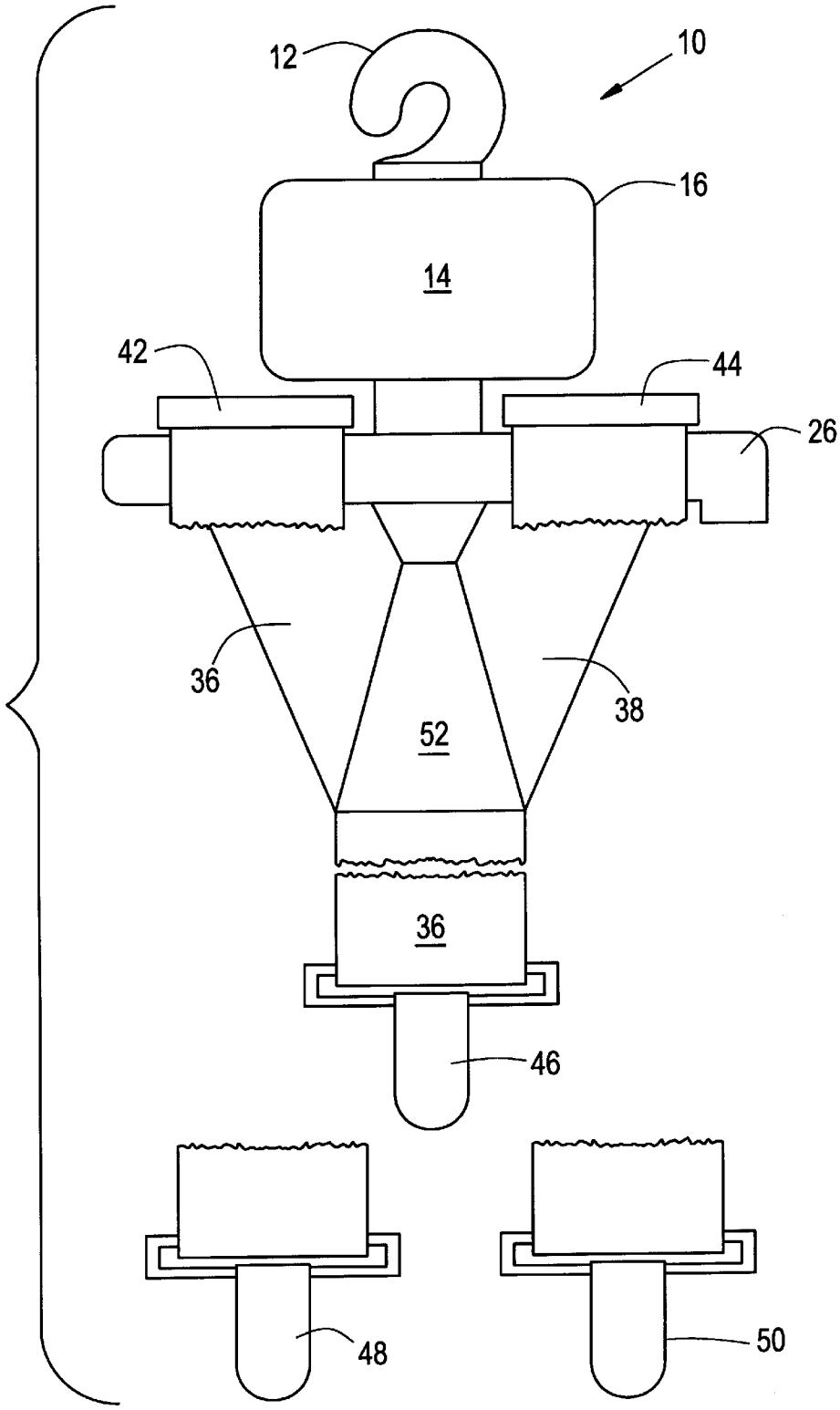
FIG. 3 is a front elevation of the FIG. 1 hanger shown in assembly with a suspenders.

In reaching the assembly of FIG. 3, portions of straps 36 and 38 of suspenders 40 are inserted into slot 34 to be resident respectively between central retention member 18 and sideward retention member 20 and central retention member 18 and sideward retention member 22. Flap member 26 is then folded onto main body portion 16 and the first and second sideward and the central securement parts are interfitted with the first and second sideward and the central retention members, respectively, which define first and second channels between the main body portion and the flap member. Suspender straps 36 and 38 are adjustable length straps, having respective length locking members 42 and 44.

The first and second channels between the main body portion and the flap member are of dimensions less than the dimensions of locking members 42 and 44, which are disposed outwardly of the channels, e.g., atop the channels as illustrated and other portions of the first and second straps are disposed respectively downwardly and frontally of the folded flap segment. Three of the four suspender trouser waistband snaps 46, 48 and 50 are illustrated in FIG. 3, the fourth suspender trouser waistband snap being unshown as it is rearwardly of snap 46. In the particularly depicted suspenders, which is but one of many versions which can be hung by hanger 10, rear clamp 52 receives both of straps 36 and 38, securing the same and passing the straps therethrough to be applied to the rear of a user's waistband.

Incorporating reference is made to commonly-assigned U.S. Pat. No. 5,615,810, which shows further details of the interfitting structure of retention members 18, 20 and 22 and securement parts 28, 30 and 32.

Viewed otherwise than in providing the one combination alluded to in the outset summary, the invention will be seen to provide, in combination, a hanger comprised of a one-piece body of plastic material, the hanger having a main body portion defining a plurality of retention members, a fold line segment depending from the main body portion and a flap member depending from the fold line segment, the flap member defining a plurality of securement parts corresponding to the retention member plurality, the flap member being folded onto the main body portion and the securement parts being interfitted with the retention members and defining first and second channels between the main body portion and the flap member and suspenders including first and second adjustable length straps, each having a length locking member, first and second portions of the first and second straps being disposed between the main body portion and the flap member respectively in the first and second channels, the first and second channels each being of dimensions lesser than dimensions of the length locking members.

Further, the invention provides, in combination, a hanger comprised of a one-piece body of plastic material, the hanger having a main body portion defining a plurality of retention members, a fold line segment depending from the main body portion and a flap member depending from the fold line segment, the flap member defining a plurality of securement parts corresponding to the retention member plurality, the flap member being folded onto the main body portion and the securement parts being interfitted with the retention members and defining first and second channels between the main body portion and the flap member and suspenders including first and second adjustable length straps, each having a length locking member, first and second portions of the first and second straps being disposed between the main body portion and the flap member respectively in the first and second channels, the length locking members being disposed exteriorly of the first and second channels.

A still further combination afforded by the invention will be seen as a hanger comprised of a one-piece body of plastic material, the hanger having a main body portion defining a plurality of retention members, a fold line segment depending from the main body portion and a flap member depending from the fold line segment, the flap member defining a plurality of securement parts corresponding to the retention member plurality, the flap member being folded onto the main body portion and the securement parts being interfitted with the retention members and defining first and second channels between the main body portion and the flap member and suspenders including first and second straps and respective front and read waistband attachment members, first and second mid-portions of the first and second straps being retentively disposed between the main body portion and the flap member respectively in the first and second channels, portions of the first and second straps respectively adjacent the mid-portions depending from the hanger frontally of the folded flap member.

Figure 5:
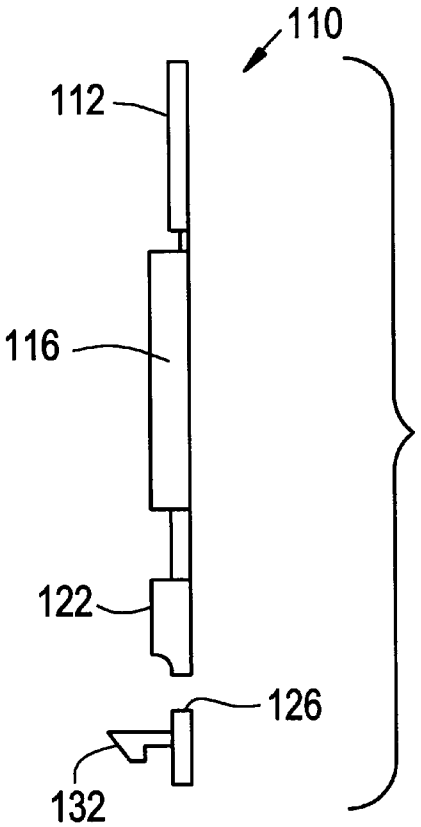
FIG. 5 is a right side elevation of the FIG. 4 hanger.
Figure 4:
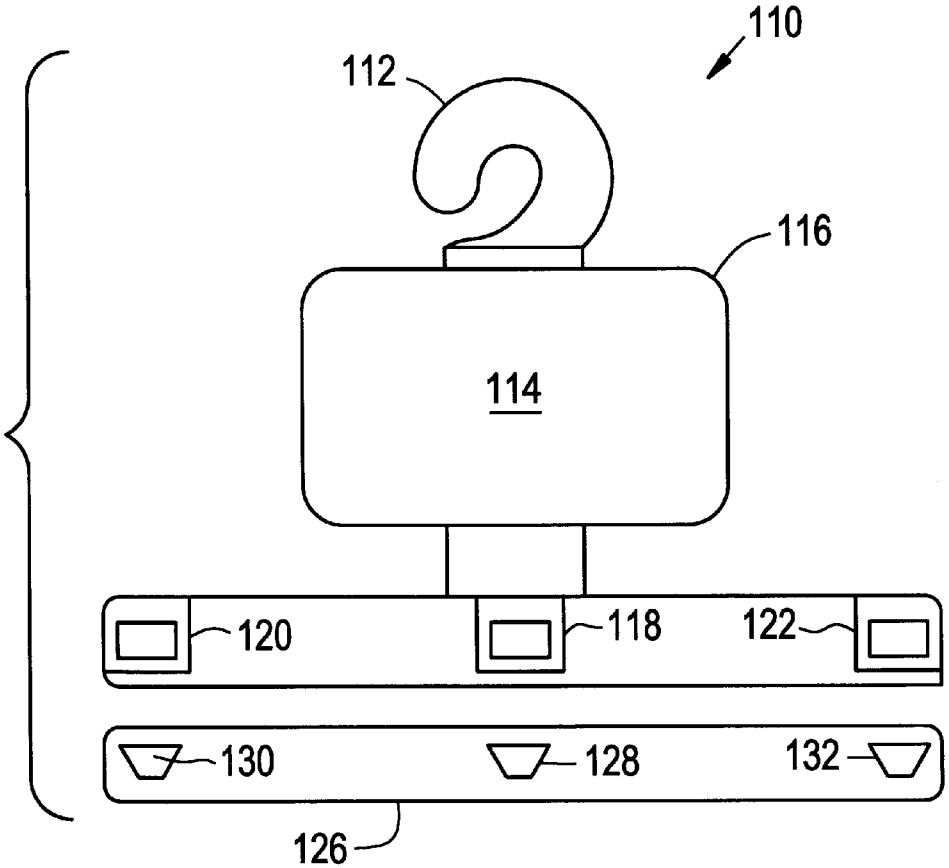
FIG. 4 is a front elevation of another hanger in accordance with the invention.

Referring to FIGS. 4 and 5, second hanger 110 of the present invention is comprised of two separate components, the first of which is an elongate, one-piece body of plastic material hanger having a hook portion 112, a logo display portion 114 and a main body portion 116.

Main body portion 116 defines a plurality of retention members including central retention member 118 and sideward retention members 120 and 122, situated substantially marginally of main body portion 116.

Flap member 126 is the second component of hanger 110 and is also provided as a one-piece body of plastic material, separate from the first component. Flap member 126 includes a plurality of securement parts corresponding to the retention member plurality, inclusive of a central securement part 128 and sideward securement parts 130 and 132.

In use of hanger 110, portions of straps 36 and 38 of suspenders 40 are applied to main body portion 116 to be resident respectively between central retention member 118 and sideward retention member 120 and central retention member 118 and sideward retention member 122. Flap member 126 is then applied onto main body portion 116 and the first and second sideward and the central securement parts are interfitted with the first and second sideward and the central retention members, respectively, which define first and second channels between the main body portion and the flap member.

Various changes to the particularly disclosed embodiment and practices may evidently be introduced without departing from the invention. By way of example, the illustrated latching structure (retention members and securement parts) is used for applications in which high security is desired and may be replaced with other latching structure in other applications. Accordingly, it is to be appreciated that the particularly discussed and depicted preferred embodiments and practices of the invention are intended in an illustrative and not in a limiting sense. The true spirit and scope of the invention are set forth in the ensuing claims.

What is claimed is:

1. In combination:

a hanger comprised of a one-piece body of plastic material, said hanger having a main body portion defining a plurality of retention members, a fold line segment depending from the main body portion and a flap member depending from the fold line segment, said flap member defining a plurality of securement parts corresponding to said retention member plurality, said flap member being folded onto said main body portion and said securement parts being interfitted with said retention members and defining first and second channels between said main body portion and said flap member; and suspenders including first and second straps, portions of said first and second straps being disposed between said main body portion and said flap member respectively in said first and second channels, other portions of said first and second straps being disposed respectively downwardly and frontally of said folded flap segment.

2. The invention claimed in claim 1, wherein said hanger further includes a hook portion upwardly of said main body portion.

3. The invention claimed in claim 1, wherein said retention members include first and second retention members disposed marginally of said main portion and a third retention member disposed laterally centrally of said main body portion.

4. The invention claimed in claim 1, wherein said securement parts include first and second securement parts disposed marginally of said flap segment and a third securement part disposed laterally centrally of said flap segment.

5. The invention claimed in claim 3, wherein said securement parts include first and second securement parts disposed marginally of said flap segment and a third securement part disposed laterally centrally of said flap segment.

6. In combination:

a hanger comprised of a one-piece body of plastic material, said hanger having a main body portion defining a plurality of retention members, a fold line segment depending from the main body portion and a flap member depending from the fold line segment, said flap member defining a plurality of securement parts corresponding to said retention member plurality, said flap member being folded onto said main body portion and said securement parts being interfitted with said retention members and defining first and second channels between said main body portion and said flap member; and suspenders including first and second adjustable length straps, each having a length locking member, first and second portions of said first and second straps being disposed between said main body portion and said flap member respectively in said first and second channels, said first and second channels each being of dimensions lesser than dimensions of said length locking members.

7. The invention claimed in claim 6, wherein said hanger further includes a hook portion upwardly of said main body portion.

8. The invention claimed in claim 6, wherein said retention members include first and second retention members disposed marginally of said main portion and a third retention member disposed laterally centrally of said main body portion.

9. The invention claimed in claim 6, wherein said securement parts include first and second securement parts disposed marginally of said flap segment and a third securement part disposed laterally centrally of said flap segment.

10. In combination:

a hanger comprised of a one-piece body of plastic material, said hanger having a main body portion defining a plurality of retention members, a fold line segment depending from the main body portion and a flap member depending from the fold line segment, said flap member defining a plurality of securement parts corresponding to said retention member plurality, said flap member being folded onto said main body portion and said securement parts being interfitted with said retention members and defining first and second channels between said main body portion and said flap member; and suspenders including first and second adjustable length straps, each having a length locking member, first and second portions of said first and second straps being disposed between said main body portion and said flap member respectively in said first and second channels, said length locking members being disposed exteriorly of said first and second channels.

11. The invention claimed in claim 10, wherein said hanger further includes a hook portion upwardly of said main body portion.

12. The invention claimed in claim 10, wherein said retention members include first and second retention members disposed marginally of said main portion and a third retention member dispose d laterally centrally of said main body portion.

13. The invention claimed in claim 10, wherein said securement parts include first and second securement parts disposed marginally of said flap segment and a third securement part disposed laterally centrally of said flap segment.

14. In combination:

a hanger comprised of a one-piece body of plastic material, said hanger having a main body portion defining a plurality of retention members, a fold line segment depending from the main body portion and a flap member depending from the fold line segment, said flap member defining a plurality of securement parts corresponding to said retention member plurality, said flap member being folded onto said main body portion and said securement parts being interfitted with said retention members and defining first and second channels between said main body portion and said flap member; and suspenders including first and second straps and respective front and read waistband attachment members, first and second mid-portions of said first and second straps being retentively disposed between said main body portion and said flap member respectively in said first and second channels, portions of said first and second straps respectively adjacent said mid-portions depending from said hanger frontally of said folded flap member.

15. The invention claimed in claim 14, wherein said hanger further includes a hook portion upwardly of said main body portion.

16. The invention claimed in claim 14, wherein said retention members include first and second retention members disposed marginally of said main portion and a third retention member disposed laterally centrally of said main body portion.

17. The invention claimed in claim 14, wherein said securement parts include first and second securement parts disposed marginally of said flap segment and a third securement part disposed laterally centrally of said flap segment.

18. In combination:

a hanger comprised of a first one-piece body of plastic material having a main body portion defining a plurality of retention members, and a second one-piece body of plastic material defining a flap member, said flap member defining a plurality of securement parts corresponding to said retention member plurality, said flap member being applied to said main body portion and said securement parts being interfitted with said central retention members, respectively and defining first and second channels between said main body portion and said flap member; and suspenders including first and second straps, portions of said first and second straps being disposed between said main body portion and said flap member respectively in said first and second channels, other portions of said first and second straps being disposed respectively downwardly and frontally of said flap segment.

19. The invention claimed in claim 18, wherein said retention members include first and second retention members disposed marginally of said main portion and a third retention member disposed laterally centrally of said main body portion.

20. The invention claimed in claim 18, wherein said securement parts include first and second securement parts disposed marginally of said flap segment and a third securement part disposed laterally centrally of said flap segment.

* * * * *

UNITED STATES PATENT AND TRADEMARK OFFICE

CERTIFICATE OF CORRECTION

PATENT NO. : 6,206,253 B1
DATED : March 27, 2001
INVENTOR(S) : Chester Kolton; Michael Norman It is certified that error appears in the above-identified patent and that said Letters Patent is hereby corrected as shown below:

Column 5,
Line 67, delete "dispose d" and insert -- disposed --.

Signed and Sealed this

Fifth Day of March, 2002

*Attest:*

*Attesting Officer*

JAMES E. ROGAN
*Director of the United States Patent and Trademark Office*